US007431448B2

(12) United States Patent
Yoshiyama

(10) Patent No.: US 7,431,448 B2
(45) Date of Patent: Oct. 7, 2008

(54) IMAGE FORMING APPARATUS

(75) Inventor: Masatoshi Yoshiyama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 339 days.

(21) Appl. No.: 10/874,252

(22) Filed: Jun. 24, 2004

(65) Prior Publication Data

US 2005/0024418 A1 Feb. 3, 2005

(30) Foreign Application Priority Data

Jun. 30, 2003 (JP) ..... 2003-188190

(51) Int. Cl.
*B41J 2/01* (2006.01)

(52) U.S. Cl. ..... 347/108; 347/19; 347/5

(58) Field of Classification Search ..... 347/23–36, 347/108, 101, 8, 19, 10, 5
See application file for complete search history.

(56) References Cited

U.S. PATENT DOCUMENTS 6,102,517 A * 8/2000 Kobayashi et al. ..... 347/23
6,325,479 B1 12/2001 Nakamura et al.
6,530,644 B2 * 3/2003 Premnath et al. ..... 347/35
2001/0033307 A1 * 10/2001 Kohno ..... 347/23

FOREIGN PATENT DOCUMENTS

| | | |
|---|---|---|
| JP | A 08-238781 | 9/1996 |
| JP | A 11-265272 | 9/1999 |
| JP | A-2000-141700 | 5/2000 |
| JP | A 2000-211161 | 8/2000 |
| JP | A 2000-229405 | 8/2000 |
| JP | A 2001-232785 | 8/2001 |

* cited by examiner

*Primary Examiner*—Manish S Shah
(74) *Attorney, Agent, or Firm*—Oliff & Berridge, PLC

(57) ABSTRACT

An image forming apparatus which makes an appropriately timed query as to whether or not an ink cartridge has been replaced and performs maintenance which preferably reflects the input from a user to the query. When the upper body of the apparatus which is opened and closed for the replacement of an ink cartridge is opened and then closed, the user is asked which colors of ink cartridges have been replaced, and then whether the cartridge has been replaced by a new ink cartridge. Flushing is performed to un-replaced ink cartridges. A single purge is performed to the ink cartridges which have been replaced by previously used ink cartridges. And a replacement purge is performed to the ink cartridges which have been replaced by new ink cartridges.

18 Claims, 13 Drawing Sheets

IMAGE FORMING APPARATUS

BACKGROUND OF THE INVENTION (1) Field of the Invention

The present invention relates to an image forming apparatus which ejects ink in an ink cartridge through a nozzle array to form an image on a recording medium, more specifically, to an image forming apparatus comprising a cover which is opened and closed for the replacement of an ink cartridge.

(2) Background Art

Image forming apparatuses comprising ink cartridges which put and retain ink inside thereof, recording heads which eject ink contained in the ink cartridges through nozzle arrays so as to form images on recording mediums, and covers which are opened and closed for replacement of ink cartridges, have all been conventionally known. In the above-mentioned image forming apparatus, ink in the ink cartridge is ejected through the nozzle array of the recording head depending on image data or the like, whereby an image can be formed on the recording medium. Also in the above-mentioned image forming apparatus, when the ink in the ink cartridge is consumed, the cover is opened for replacement of the ink cartridge and is closed again in order to perform the image forming operation.

When the ink cartridge is replaced by a new ink cartridge, it is required to purge the ink within the ink cartridge to the nozzle array of the recording head and to perform maintenance so as to prepare the system for image forming. However, when only some of the ink cartridges are replaced, it is not preferable to perform the same maintenance for each nozzle array corresponding to all of the ink cartridges. For example in a multicolor image forming apparatus, which comprises a plurality of nozzle arrays and ink cartridges, when just a few of the ink cartridges are replaced, it is not preferable to perform the same level of maintenance on the nozzle arrays corresponding to the unreplaced ink cartridges as in the case of nozzle arrays corresponding to ink cartridges replaced by new ink cartridges. Using the same level of maintenance would be a waste of ink.

Therefore, in a computer-connected image forming apparatus, it is desirable that after selecting a replacement mode for the ink cartridges, a user is asked via a computer or other interface whether or not an ink cartridge has actually been replaced (for example, see Publication of Unexamined Japanese Patent Application 2001-232785).

However, unless the query of whether or not the ink cartridge has been replaced is made with the appropriate amount of timing, there is a possibility that the query process may timeout while the user is performing the replacement. And without closing the cover of the image forming apparatus, the user may inadvertently input the termination of the replacement process, and consequently the maintenance may be performed directly.

SUMMARY OF THE INVENTION

An object of the present invention is to provide an image forming apparatus which makes a query with the appropriate timing of whether or not an ink cartridge has been replaced, and which preferably allows input for the query from a user regarding maintenance.

To attain the above and other objects, an image forming apparatus comprises at least one ink cartridge which applies ink and stores ink inside thereof, a recording head which ejects the ink from the ink cartridge through a nozzle array in order to form an image on a recording medium, and a cover which is opened and closed for replacement of ink cartridges. The image forming apparatus also comprises an input device through which a user can input various instructions or information; a cover closing detection device for detecting the closing of the cover as a change from an open state to a closed state at least; a query device for asking the user regarding all of the ink cartridges whether or not replacement of the ink cartridges has actually been carried out, when the user inputs an instruction to replace ink cartridge via the input device and the cover closing detection device detects the closing of the cover from an open state to a closed state; and a maintenance device for performing the maintenance of the recording head corresponding to an ink cartridge based upon information that the user inputted for the query of the query device through the input device.

In the present invention as configured above, the user inputs an instruction to replace ink cartridge through the input device. The cover closing detection device detects a change in state (from an open state to a closed state) of the cover which is opened and closed for the replacement of an ink cartridge. The query device asks the user whether or not replacement of the ink cartridges has actually been carried out for all of the ink cartridges. And the maintenance device performs maintenance of a recording head corresponding to an ink cartridge based upon information that the user inputted for the query of the query device through the input device. Therefore, in the present invention, the maintenance can be appropriately performed based on whether or not the ink cartridge has actually been replaced.

In the present invention, when the cover is closed, the query is made by the query device. Consequently, even if the user takes a long time for the replacement of ink cartridge, an error, e.g. time-out error, does not occur. Furthermore, the maintenance is not performed while the cover is open. Therefore, in the present invention, the timing of the query is properly adjusted, and the input for the query from the user can be preferably incorporated with the maintenance.

In the present invention, when the user does not provide input for the query of the query device, indicating that a replacement has been made, flushing is performed on the recording heads corresponding to all of the ink cartridges.

Therefore, the present invention has an effect of preferably maintaining the ejection performance even of the recording heads corresponding to the un-replaced ink cartridges.

In the present invention, the query device comprises a first query device for asking whether or not an ink cartridge has been replaced. The query device also comprises a second query device for asking whether or not an ink cartridge has been replaced by a new ink cartridge, when the user inputs to the query of the first query device that the ink cartridge has been replaced. When the user inputs for the query of the second query device that the ink cartridge has been replaced by a new ink cartridge, the maintenance device can perform the maintenance of the recording head corresponding to the ink cartridge which has been replaced.

When an ink cartridge has been replaced, the necessary maintenance varies according to whether or not the ink cartridge has been replaced by a new ink cartridge. Therefore, in the present invention, the first query device makes a query as to whether the ink cartridge has been replaced. When the user inputs that the ink cartridge has been replaced, the second query device makes a query as to whether or not the ink cartridge has been replaced by a new ink cartridge. When the user inputs for the second query device that the ink cartridge has been replaced by a new ink cartridge, maintenance is performed on the recording head corresponding to the ink cartridge which has been replaced. Therefore, in the present invention, more appropriate maintenance can be carried out to the recording head corresponding to an ink cartridge which has been replaced by a new ink cartridge.

In the present invention, the maintenance device is configured to be able to at least perform a purging operation on a nozzle array. When the user inputs for the query of the second query device that the ink cartridge has been replaced by a new ink cartridge, the maintenance device repeats the purging operation on a nozzle array of the recording head corresponding to the ink cartridge as many times as necessary until the ink in the ink cartridge reaches the nozzle array.

Consequently, the recording head can be always ready for image forming. If the purging operation is performed to a once-used or a previously used ink cartridge, it will be a waste of ink. However, in the present invention, the purging operation is primarily performed to the nozzle array of the recording head corresponding to the ink cartridge which has been replaced by a new ink cartridge. Therefore, the present invention has the effect that the waste of ink is avoided, and that a more preferable image forming can be achieved.

In the present invention, when the user does not input to the query of the second query device that the ink cartridge has been replaced by a new ink cartridge, the maintenance device performs the purging operation just once to the nozzle array of the recording head corresponding to the ink cartridge.

Therefore, the ejection performance of the recording head corresponding to the ink cartridge which has been replaced by an ink cartridge used once is maintained; furthermore, a more preferable image forming can be accomplished.

In the present invention, the recording heads comprise a plurality of nozzle arrays through which different colors of ink are ejected. Ink cartridges are provided for each color. The query device makes a query sequentially for each color. And the maintenance device performs the maintenance of the nozzle array of the recording head corresponding to the replaced color ink cartridge.

In the image forming apparatus as above, the amount of ink used varies by color and only some colors of the ink cartridges are frequently replaced. Consequently, the query device makes the query sequentially for each color, and the maintenance device performs the maintenance of the nozzle array of the recording head corresponding to the replaced color ink cartridge. Therefore, the present invention has an effect that the waste of ink caused by the maintenance assuming the replacement of all of the ink cartridges can be avoided more preferably.

In the present invention, the maintenance device repeats the purging operation several times to the nozzle array of the recording head corresponding to the replaced color ink cartridge or a plurality of nozzle arrays of the recording heads corresponding to a plurality of replaced color ink cartridges. And the maintenance device may perform the purging operation fewer times to the other nozzle arrays of the recording heads corresponding to the un-replaced color ink cartridges.

Consequently, the recording head corresponding to the replaced color ink cartridge can be always ready for image forming, while the ejection performance of the other recording heads is maintained as well. Therefore, the present invention has an effect that a more preferable image can be formed.

In the present invention, the query device sequentially displays a message of the query for each color on a display portion of the image forming apparatus.

Even if the display portion is small, a large screen (e.g. personal computer) is not required because the query may be sequentially made for each color. Therefore, the present invention has an effect that it can be easily applied to a stand-alone image forming apparatus including a small display portion.

In the present invention, the input device is configured as an operation panel of the image forming apparatus. Consequently, the present invention can be used as a so-called "stand-alone" apparatus which is independent from a computer or the like. Therefore, the present invention has the effects that it can be used as a stand alone apparatus and that the operational performance can be more improved according to its individual use environment.

In the present invention, the input device is configured by an information processing device connected to the image forming apparatus, so that remote operation is possible through an information processing device such as a computer. Therefore, the present invention has effects that the remote operation is possible, and that an operational performance can be more improved according to its individual use environment.

In the present invention, the ink cartridges are mounted on a carriage along with the recording heads. And the cover is a body cover of the image forming apparatus.

As a system for determining whether or not the ink cartridge has been replaced, sensors may be provided at respective positions on the carriage where the ink cartridges are mounted. However in this case, the carriage may become heavy and therefore this is not a desirable system. Furthermore, the configuration of the carriage may become more complicated. Ink may attach to the sensor and consequently the sensor may not operate normally. Therefore, it is not appropriate to provide sensors at positions where the ink cartridges are mounted.

Instead of providing such sensors, providing the query device and the input device allows the apparatus in the present invention to determine whether or not the ink cartridge has been replaced. Also in the image forming apparatus as above, it is preferable that the body cover should always be closed after replacement of an ink cartridge, and that the maintenance should be performed with the body cover closed. Consequently, the procedures of the query device, etc., are performed with the closing of the body cover (the cover) being identified as a trigger.

BRIEF DESCRIPTION OF THE DRAWINGS

The present invention will now be described, by way of example, with reference to the accompanying drawings, in which.

DETAILED DESCRIPTION OF THE PREFERRED EMBODIMENT

Figure 1:
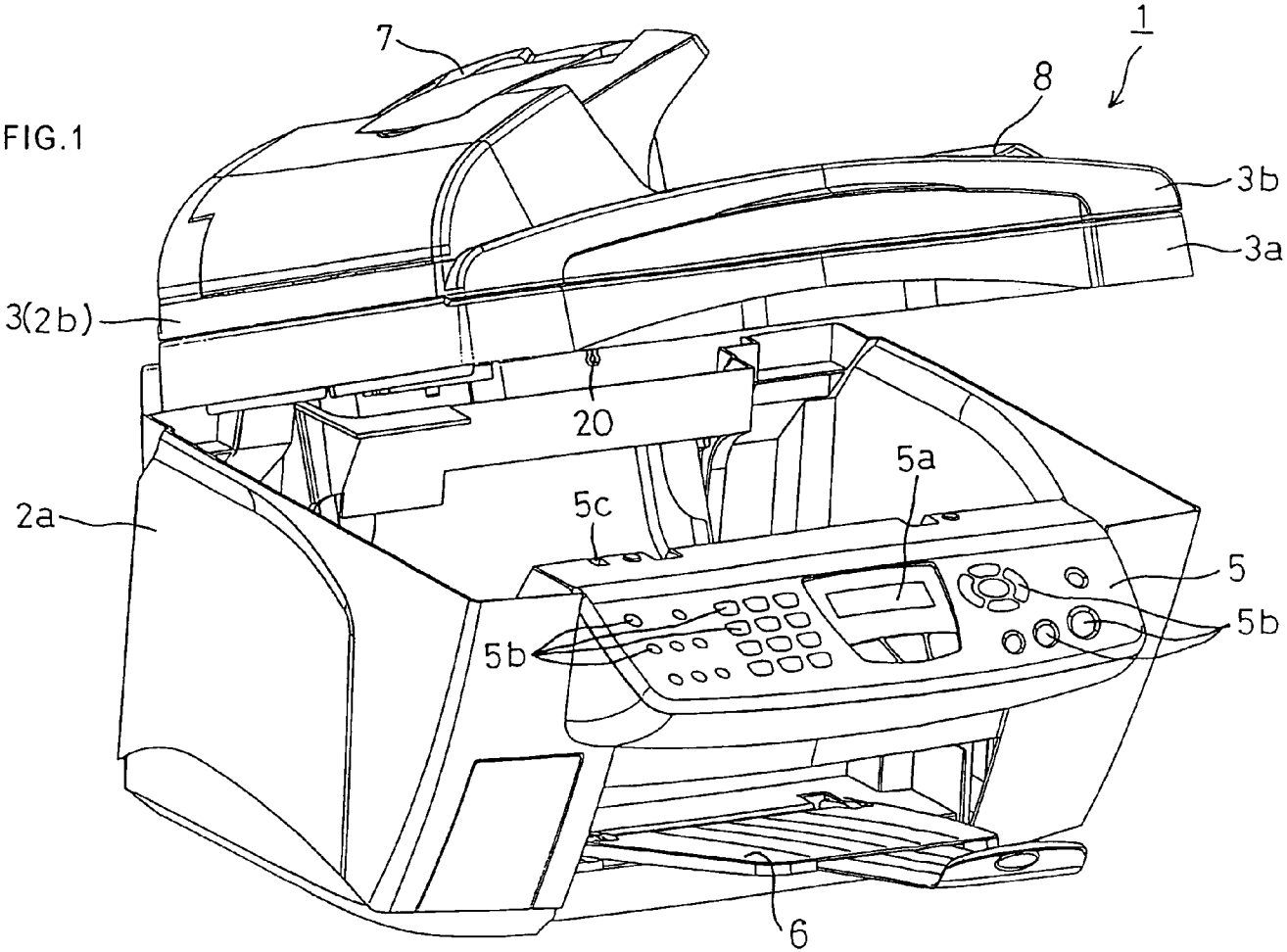
FIG. 1 is a perspective view of an entire appearance of a multifunction device according to the invention.

As illustrated in FIG. 1, the multifunction device 1 has a clamshell-shaped (or rear hinged) open and close configuration. An upper body 2*b* is attached to a lower body 2*a* as an apparatus housing so as to allow the upper body 2*b* to open and close. The upper body 2*b* and the lower body 2*a* comprise image forming portions such as an image reading apparatus 3 and a printer engine 4 (refer to FIG. 2B), respectively.

An operation panel 5 is provided in front of the lower body 2*a*. The operation panel 5 comprises an LCD 5*a* and various input keys 5*b*. A discharge tray 6 is provided under the operation panel 5 in order to discharge not shown recording paper on which an image has been formed by the image forming portion.

The image reading apparatus 3 has both a flatbed function (FB) and an automatic document feeder function (ADF). The image reading apparatus 3 has a clamshell-shaped open and close configuration. A cover portion 3*b*, as a cover of a document holder, is attached to a flatbed portion 3*a* as a document holder so as to allow the cover portion 3*b* to open and close. The cover portion 3*b* is provided with a document feeding tray 7, which is used for automatic document feed, and a document discharge tray 8. Platen glass (not shown) for locating a document is provided on the upper surface of the flatbed portion 3*a*. An image sensor 9 (refer to FIG. 5) is provided underneath the platen glass.

The image reading apparatus 3 is a common apparatus, i.e. after a document in the document feeding tray 7 is transferred to the front side of the image sensor 9 for an image reading, the document is discharged to the document discharge tray 8. And the image sensor 9 is actuated along the platen glass of the flatbed portion 3*a* to read the image of the document placed on the platen glass.

Figure 2A:
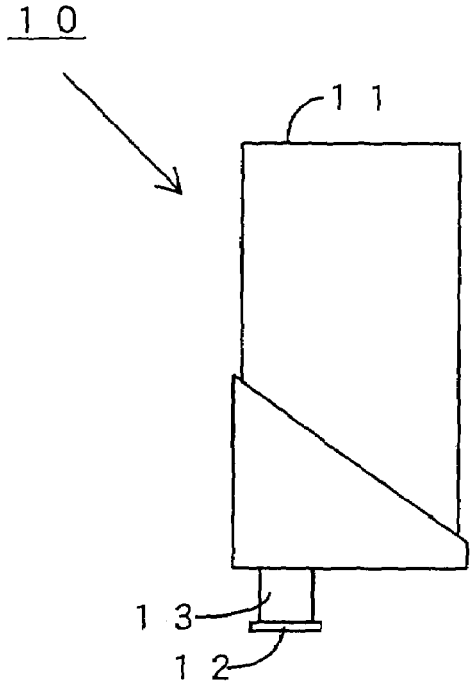
FIGS. 2A and 2B are explanatory views of a configuration of a printer engine of the multifunction device.

The printer engine 4 comprises a recording head 10 as illustrated in FIG. 2A. The recording head 10 is constituted so that an ink cartridge 11 can be attached and detached freely therefrom and thereto. And the recording head 10 comprises an actuator 13 which ejects ink contained in the ink cartridge 11 through a nozzle plate 12 onto a recording medium, e.g. paper.

Figure 2B:
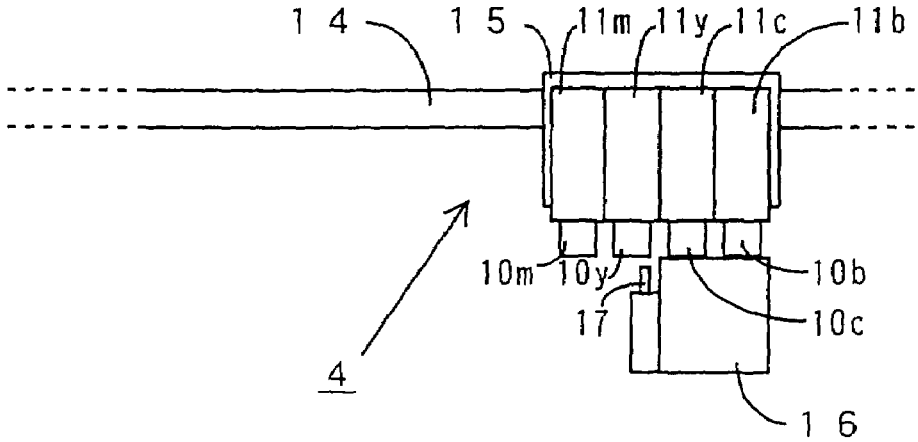

As shown in FIG. 2B, four recording heads 10 are provided corresponding to four separate colors: magenta, yellow, cyan, and black (10*m*, 10*y*, 10*c*, and 10*b*: hereinafter, if distinction between the colors is necessary, the same subscripts are added to codes for each portion). The four recording heads 10 are mounted on a carriage 15 which moves along a guide 14 in a direction perpendicular to the transfer direction of a recording paper. At one end of the moving direction of the carriage 15, there are provided maintenance devices such as a suction cap 16 for performing a purging operation to the nozzle arrays provided in the nozzle plates 12 corresponding to each color of the recording heads 10, and a wiper 17 for wiping the nozzle plates 12. In the vicinity thereof, a flushing area is located in order to allow every recording head 10 to perform a flushing operation. In the purging operation, the suction cap 16 is fitted over the recording heads 10 and then ink in the recording heads 10 is purged from the nozzle arrays by negative pressure generated by a suction pump 19 (refer to FIG. 5) in the suction cap 16. In the flushing operation, a small amount of ink is ejected from the nozzle array of the recording head 10 using the actuator 13 so as to maintain a high quality of image.

As seen in FIG. 1, a rectangular penetrating hole 5*c* is provided on the edge of the upper surface of the lower body 2*a* (specifically, on the left edge of the upper surface of the operation panel 5). A protruding portion 20, which performs a tactile-response engagement with the penetrating hole 5*c*, is provided on the edge of the under surface of the flatbed portion 3*a*, which constitutes a part of the upper body 2*b*. The engagement between the protruding portion 20 and the penetrating hole 5*c* maintains the closed state of the flatbed portion 3*a* with respect to the lower body 2*a*.

Due to this engagement, the operation is simplified in which only the cover portion 3*b* is opened to allow the flatbed function (FB) to read the image. In short, the top views of the flatbed portion 3*a* and the cover portion 3*b* are designed to be in the form of approximately congruent rectangles. And the flatbed portion 3*a* and the cover portion 3*b* are designed to be opened and closed around an edge on the same side of the surfaces (a longer side). However, the engagement as described above facilitates the opening of only the upper cover portion 31*b*.

Figure 3:
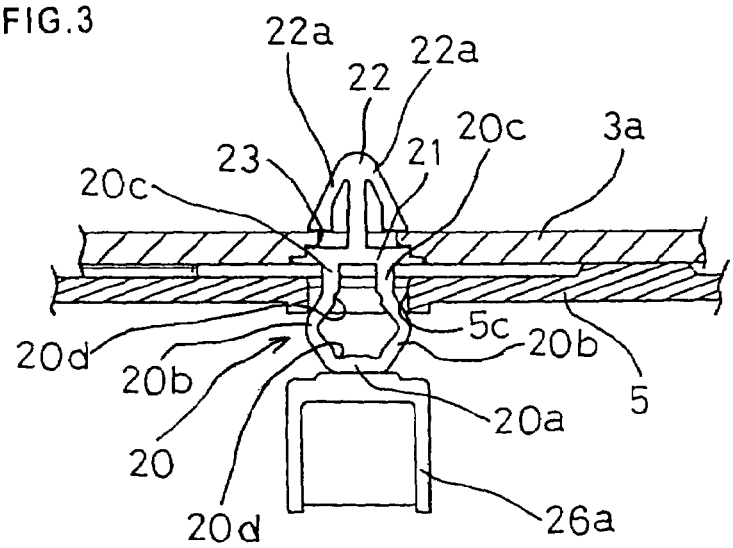
FIG. 3 is an enlarged view of a configuration in the vicinity of a protruding portion and a penetrating hole of the multifunction device.

FIG. 3 is an enlarged view of the configuration in the vicinity of the protruding portion 20. As illustrated in FIG. 3, the protruding portion 20 comprises; a horizontal portion 20*a* in parallel with the under surface of the flatbed portion 3*a*; a pair of elastic portions 20*b* whose bottom ends are connected to both ends of the horizontal portion 20*a* and which have approximately V-shaped configurations opposed to each other; and connecting portions 20*c* which extend vertically from the upper ends of the elastic portions 20*b* so as to be connected with a flange portion 21.

A mounting hole 23, formed stepwise so as to make the diameter bigger downwardly, is provided on the under surface of the flatbed portion 3*a*. The flange portion 21 is engaged with the mounting hole 23, so that the under surface of the flange portion 21 becomes flat or substantially flush with that of the flatbed portion 3*a*. Also, a periphery of the flange portion 21 is formed stepwise. The step of the flange portion 21 is engaged with that of the mounting hole 23, thereby blocking dust from entering the flatbed portion 3*a*.

In the center of the flange portion 21, an engaging portion 22 is provided in a direction opposite to the protruding portion 20. After the engaging portion 22 is pressed into the mounting hole 23, both wings 22*a* are spread out. Consequently, the protruding portion 20 and the flange portion 21 are fixed to the under surface of the flatbed portion 3*a*. The protruding portion 20, the flange portion 21 and the engaging portion 22 are integrally molded preferably with elastic poly acetal resin (POM: polyoxymethylene). Constricted portions 20*d* are provided inside of the connecting parts between both ends of the horizontal portion 20*a* and the bottom ends of the elastic portions 20*b*, and between the connecting parts between the upper ends of the elastic portions 20*b* and the connecting portion 20*c*. Therefore, the protruding portion 20 whose side view is approximately in the form of hexagon is preferably constricted, with the protruding portion 20 crushing the hexagon in the longitudinal direction (the transfer direction of the protruding portion 20 caused by the opening and closing operation of the flatbed portion 3*a*) as well as in the lateral direction (the direction perpendicular to the aforementioned transfer direction).

The penetrating hole 5*c* of the operation panel 5 (made of polystyrene) is 7.1±0.05 mm in the lateral direction in FIG. 3. The protruding portion 20 (i.e. the distance between the tops of the elastic portions 20*b*) is 7.7±0.05 mm in the lateral direction in FIG. 3. Thus, the protruding portion 20 is elastically deformed in the direction that the diameter is constricted so as to pass through the penetrating hole 5*c*. After passing through the penetrating hole 5*c*, the protruding portion 20 recovers to approximate some of its original state; thereby fixing the flatbed portion 3*a* to the upper surface of the operation panel 5. Additionally, the inner wall of the penetrating hole 5*c* abuts the V-shaped inclined portions of each elastic portion 20*b*. Therefore, the opening and closing operation of the upper body 2*b* can be performed more smoothly and the tactile-response engagement can be more stable.

A small clearance (i.e., looseness) is horizontally provided between the protruding portion 20 which recovers toward its original state and the penetrating hole 5*c*. In the embodiment, an elastic tactile-response engagement between the protruding portion 20 and the penetrating hole 5*c* are utilized; furthermore, the looseness is provided as described above. Therefore, even though the positional relationship between the protruding portion 20 and the penetrating hole 5*c* is relatively rough or not tightly controlled, the tactile-response engagement can be preferably achieved. Also, the engagement between the protruding portion 20 and the penetrating hole 5*c* is relatively strong against a force applied in a vertical direction. Therefore, even if the protruding portion 20 and the penetrating hole 5*c* are provided at only a single place, the upper body 2*b* can be preferably retained in a closed position.

Figure 4A:
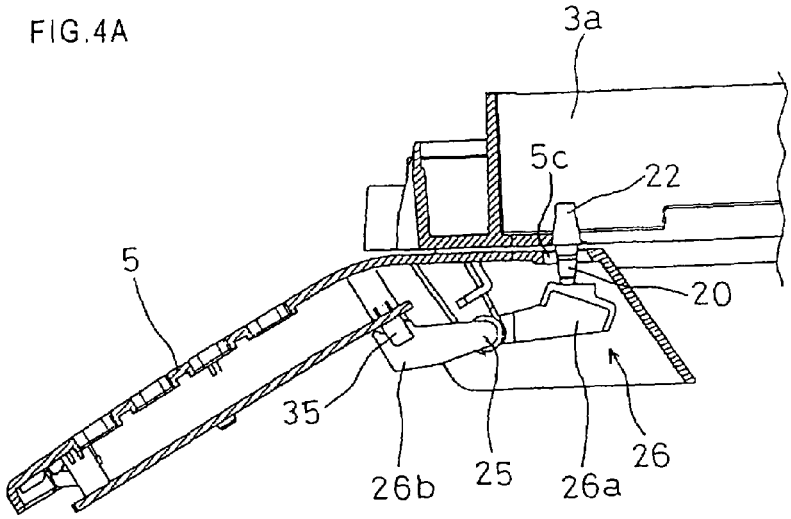
FIGS. 4A and 4B are explanatory views of a configuration of an opening and closing detection device of the multifunction devices.
Figure 4B:
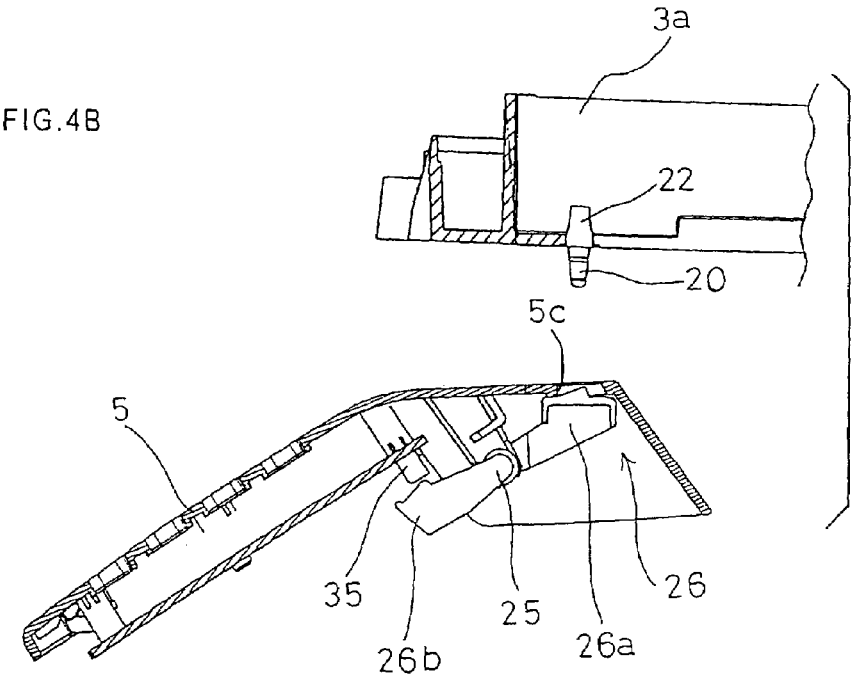

As shown in FIGS. 4A and 4B, a transfer member 26, which swings around a supporting point 25, is provided on the under surface of the operation panel 5. An end 26*a* of the transfer member 26 is visibly contacted with the penetrating hole 5*c* as shown in FIG. 4B. When the flatbed portion 3*a* is closed, the end 26*a* is pressed against the horizontal portion 20*a* of the protruding portion 20. Consequently, as illustrated in FIG. 4A, the transfer member 26 swings in the clockwise direction. In the vicinity of the other end 26*b* of the transfer member, there is provided an opening and closing sensor 35 which is constituted by an optical sensor as a cover opening and closing detection device. After the transfer member 26 swings as described above, the other end 26*b* of the transfer member 26 interrupts the optical path of the opening and closing sensor 35. The transfer member 26 is supported by a supporting point 25 for balance in such a way that the other end 26*b* is heavier than the end 26*a*. Thus, once the flatbed portion 3*a* is open, the end 26*a* swings until exposed in the penetrating hole 5*c*. And the optical path of the opening and closing sensor 35 is no longer interrupted.

Figure 5:
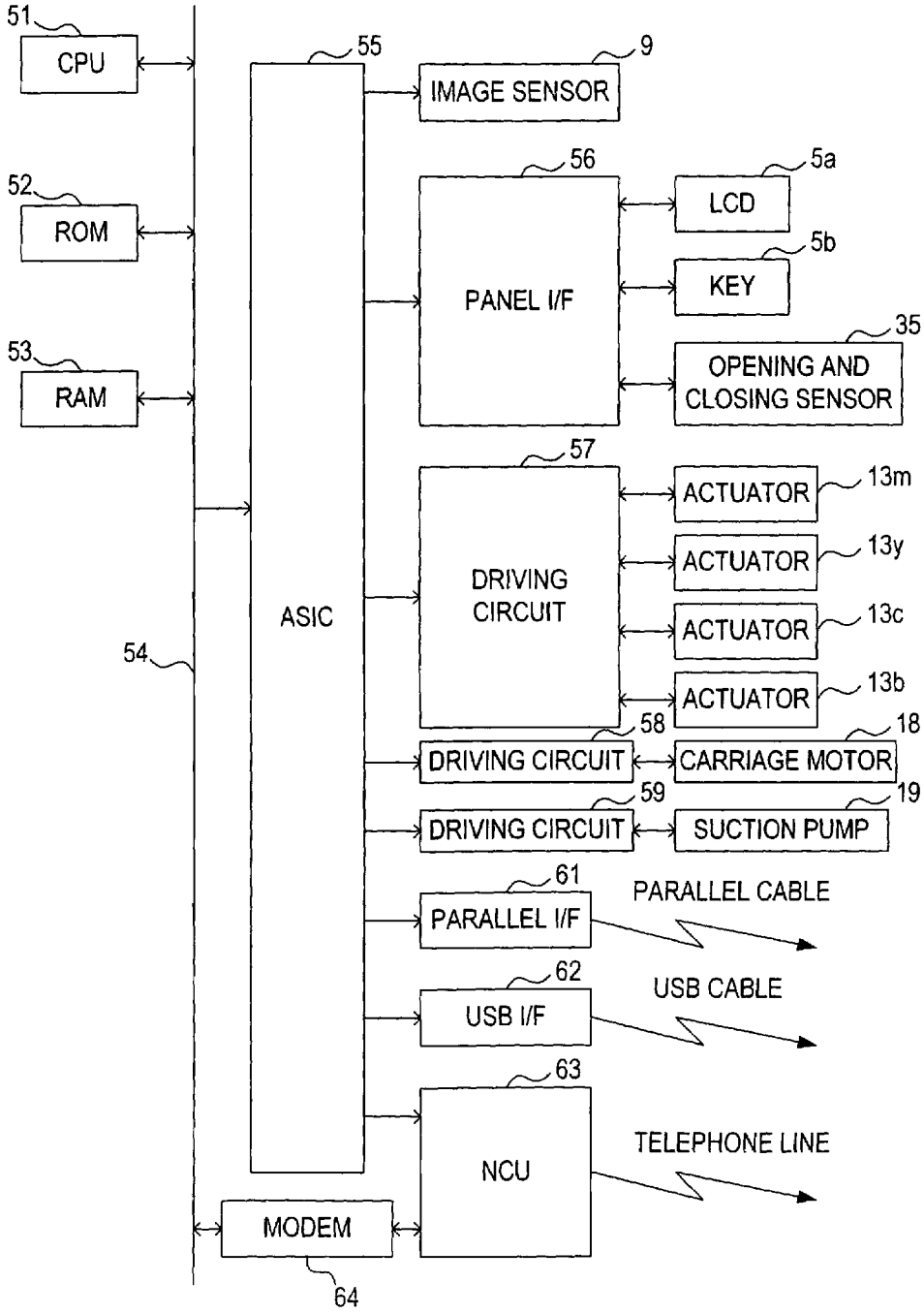
FIG. 5 is a block diagram of a configuration of a control system of the multifunction device.

In the multifunction device 1, the opening and closing of the flatbed portion 3*a* is detected by the opening and closing sensor 35, and the following control is executed. FIG. 5 is a block diagram of a configuration of a control system of the multifunction device 1. As illustrated in FIG. 5, the control system is mainly configured as a microcomputer which is connected to CPU 51, ROM 52, and RAM 53, via a bus 54. The bus 54 is connected to an ASIC (Application Specific Integrated Circuit) 55 as well.

The image sensor 9 is connected to the ASIC 55. The LCD 5*a* of the operation panel 5, the various keys 5*b*, and the opening and closing sensor 35 are connected to the ASIC 55 through a panel interface (panel I/F) 56. The actuators 13*m*, 13*y*, 13*c*, and 13*b*, corresponding to the colors of the recording heads 10 are connected to ASIC 55 through a driving circuit 57. A carriage motor 18 for traveling the carriage 15 is connected to the ASIC 55 through a driving circuit 58. The suction pomp 19 for performing a purging operation to the nozzle arrays is connected to the ASIC 55 through a driving circuit 59. A parallel interface (parallel I/F) 61 for communication via a parallel cable, a USB interface (USB I/F) 62 for communication via a USB cable, and a NCU 63 for communication via telephone line etc., are connected to the ASIC 55.

Although their figures are not shown here, various motors used to transfer recording paper and documents are also connected to the ASIC 55. The NCU 63 is connected to the bus 54 as well via a modem (MODEM) 64.

Figure 6:
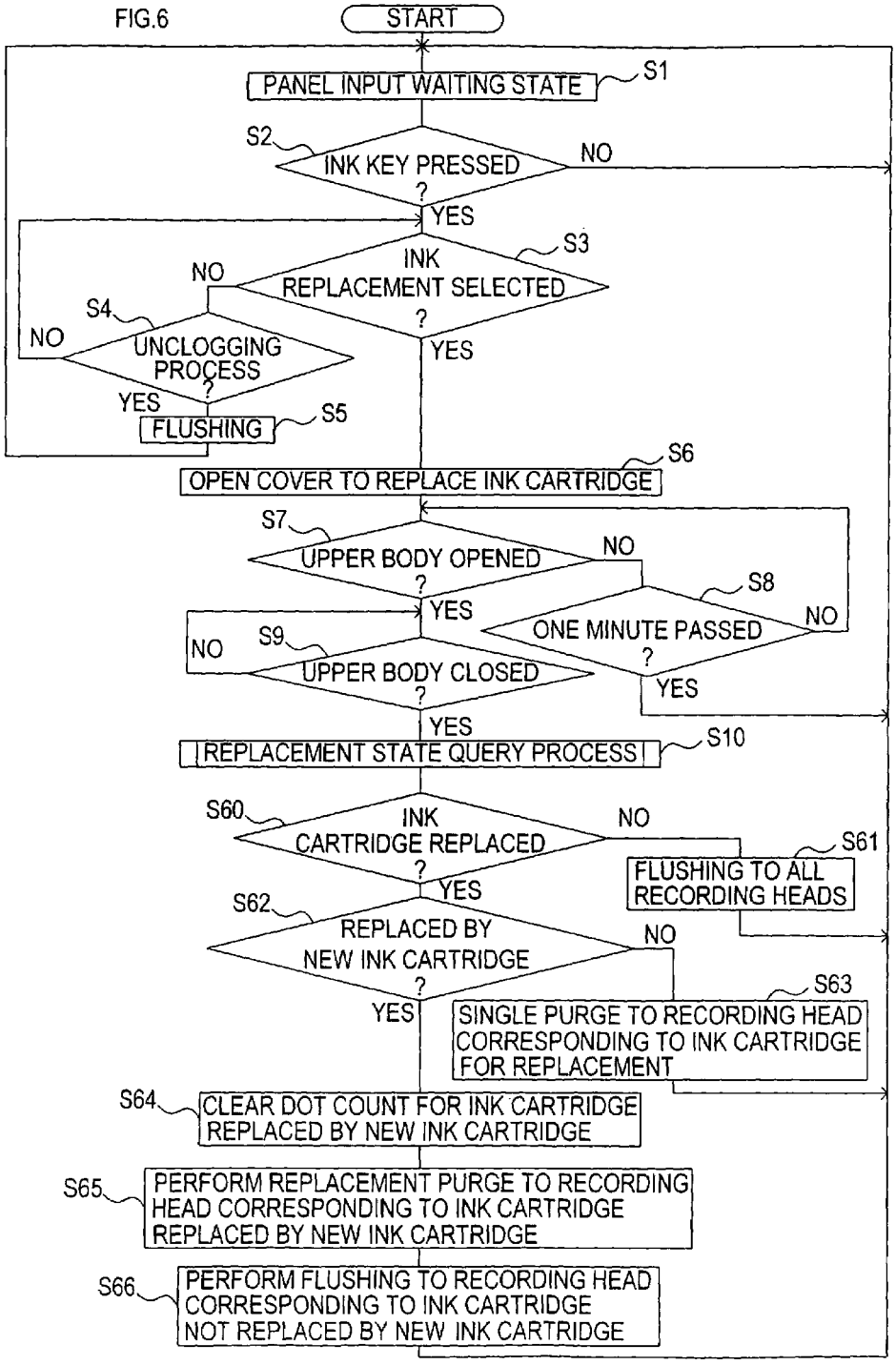
FIG. 6 is a flowchart of a process that the control system executes in a stand-by state.

The process that the CPU 51 performs is based upon a program recorded in the ROM 52 and will now be described. FIG. 6 is a flowchart of the process that the CPU 51 performs in a stand-by state. When the process is started, the CPU 51 first causes the display of the LCD 5*a* to be in a panel input waiting state in S1 (S represents a single step). Then in S2, whether or not an ink key has been pressed down is determined. When it is determined that the ink key has not been pressed down (S2: NO), the panel input waiting state in S1 is maintained. When it is determined that the ink key has been pressed (S2: YES), the procedure moves to S3.

In S3, whether or not the ink replacement has been selected is determined. When it is determined that the ink replacement has not been selected (S3: NO), the procedure moves to S4 to determine whether or not the unclogging process has been selected. When it is determined that the unclogging process has also not been selected (S4: NO), the procedure returns to S3 to repeat the processes of S3 and S4 until either process is selected. If the unclogging process is selected (S4: YES), flushing is performed to all of the recording heads 10, and the procedure moves to S1.

On the other band, if the ink replacement is selected (S3: YES), the procedure moves to S6. In S6, a message indicating "OPEN COVER TO REPLACE INK CARTRIDGE" is displayed on the LCD 5*a*. Once the message is displayed, the user of the multifunction device 1 opens the upper body 2*b* (the flatbed portion 3*a* and the cover portion 3*b*), replaces the ink cartridge 11 of an appropriate color, and closes the upper body 2*b*.

In S7 following S6, whether or not the upper body 2*b* has been open is determined based upon the detection signals of the opening and closing sensor 35. When the upper body 2*b* has not been open (S7: NO), the procedure moves to S8 to determine whether or not a predetermined time, for example, one minute has passed. When one minute has not passed (S8: NO), the procedure returns to S7. When one minute has passed while the processes of S7 and S8 are repeated (S8: YES), the procedure returns to the aforementioned process of S1. On the other hand, when the upper body 2*b* has been open while the processes of S7 and S8 are repeated (S7: YES), the procedure waits until the upper body 2*b* is closed in S9. When the upper body 2*b* is closed (S9: YES), the procedure moves onto S10 to execute the following replacement state query process.

Figure 7:
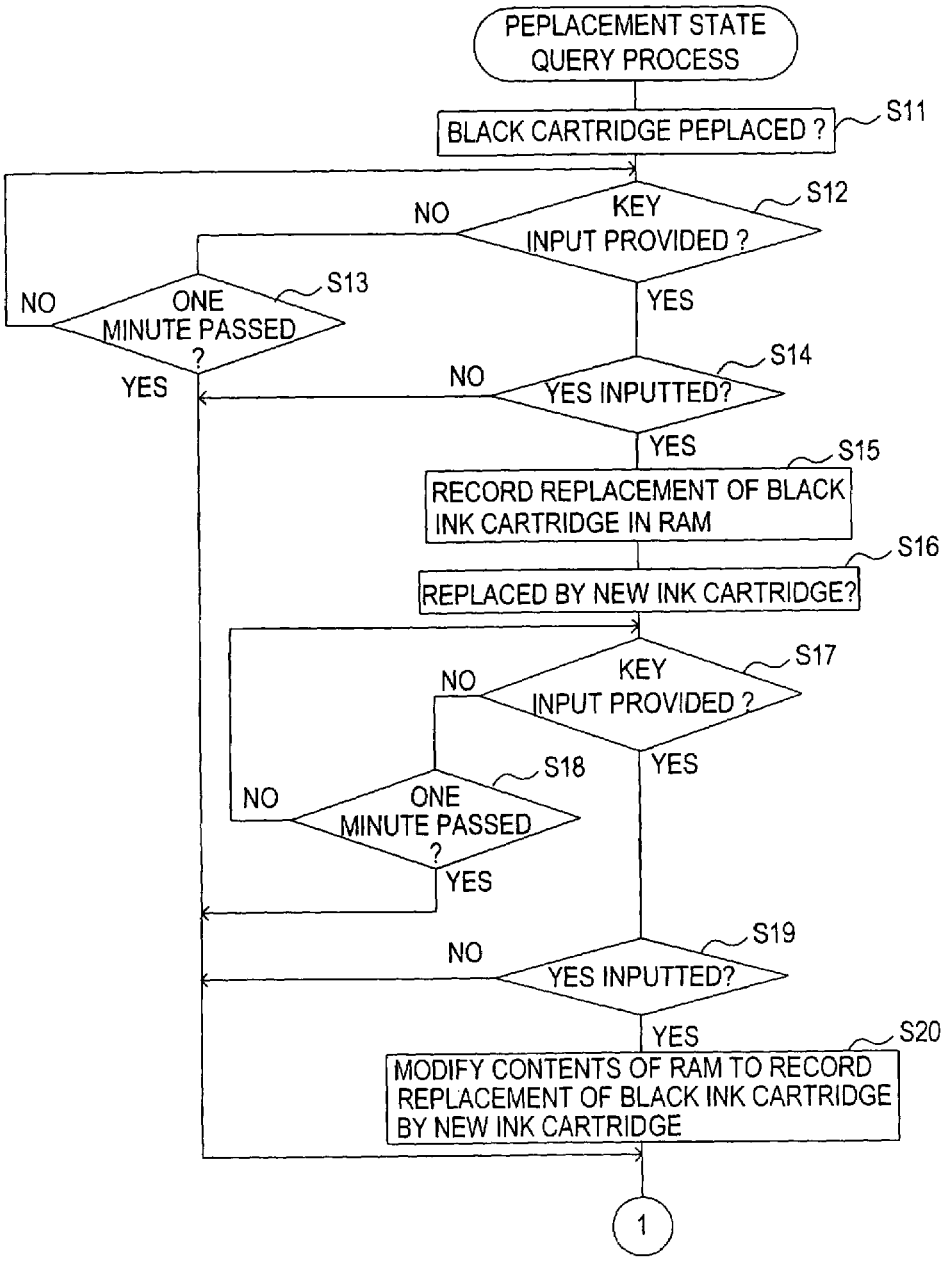
FIG. 7 is a flowchart of a replacement state query process during the process.

In the replacement state query process, a message indicating "BLACK INK CARTRIDGE REPLACED?" is first displayed on the LCD 5*a* in S11 as illustrated in FIG. 7. In S12, it is determined whether or not key input has been performed. When it is determined that key input has not been performed (S12: NO), the procedure moves onto S13. In S13, it is determined whether or not a predetermined time, for example, one minute has passed. When one minute has not passed (S13: NO), the procedure returns to S12. When one minute has passed without any key input (S13: YES), it is determined that the ink cartridge 11*b* has not been replaced, and the procedure moves onto S21 in FIG. 8.

On the other hand, if the key input has been provided before one minute passes (S12: YES), it is determined whether or not YES has been inputted with respect to the above described message in S14. The key input in this case may be replaced by numbers such as YES=1 and NO=2, or other known equivalents for indicating an answer to a YES or No question.

When it is determined that YES has been inputted (S14: YES), the procedure moves to S15 to record in the RAM 53 that the black ink cartridge 11*b* has been replaced. In S16, a message indicating "REPLACED BY NEW INK CARTRIDGE?" is displayed on LCD 5*a*. In S17, whether or not a key input has been provided is determined. When it is determined that a key input has not been provided (S17: NO), the procedure moves to S18. In S18, it is determined whether or not a predetermined time, for example, one minute has passed. When it is determined that one minute has not passed (S18: NO), the procedure returns to S17. When it is determined that one minute has passed without any key input (S18: YES), it is determined that the ink cartridge 11*b* has not been replaced by a new ink cartridge 11*b*, and the procedure moves to S21 in FIG. 8.

On the other hand, if a key input is provided before one minute passes (S17: YES), it is determined in S19 whether or not YES has been inputted with respect to the message. If YES has been inputted (S19: YES), the procedure moves to S20. The recorded contents of the RAM 58 stored in S15 are modified to represent that the black ink cartridge 11*b* has been replaced by the new one, and the procedure moves to S21 in FIG. 8. If NO has been inputted in S14 or S19 (S14: NO or S19: NO), all the procedures that follow are skipped and the control moves directly to S21.

Figure 8:
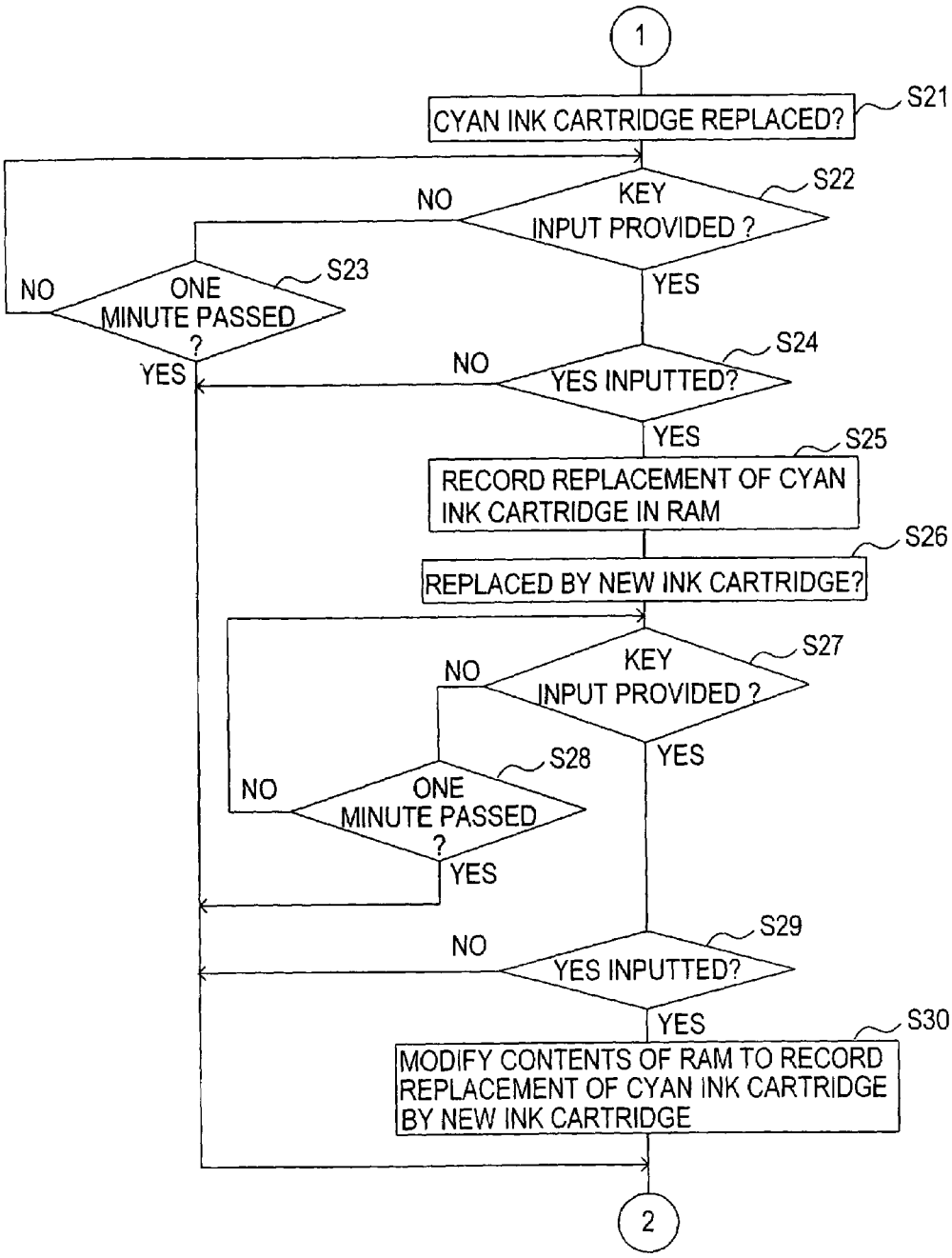
FIG. 8 is a flowchart of a continuation of the replacement state query process.
Figure 9:
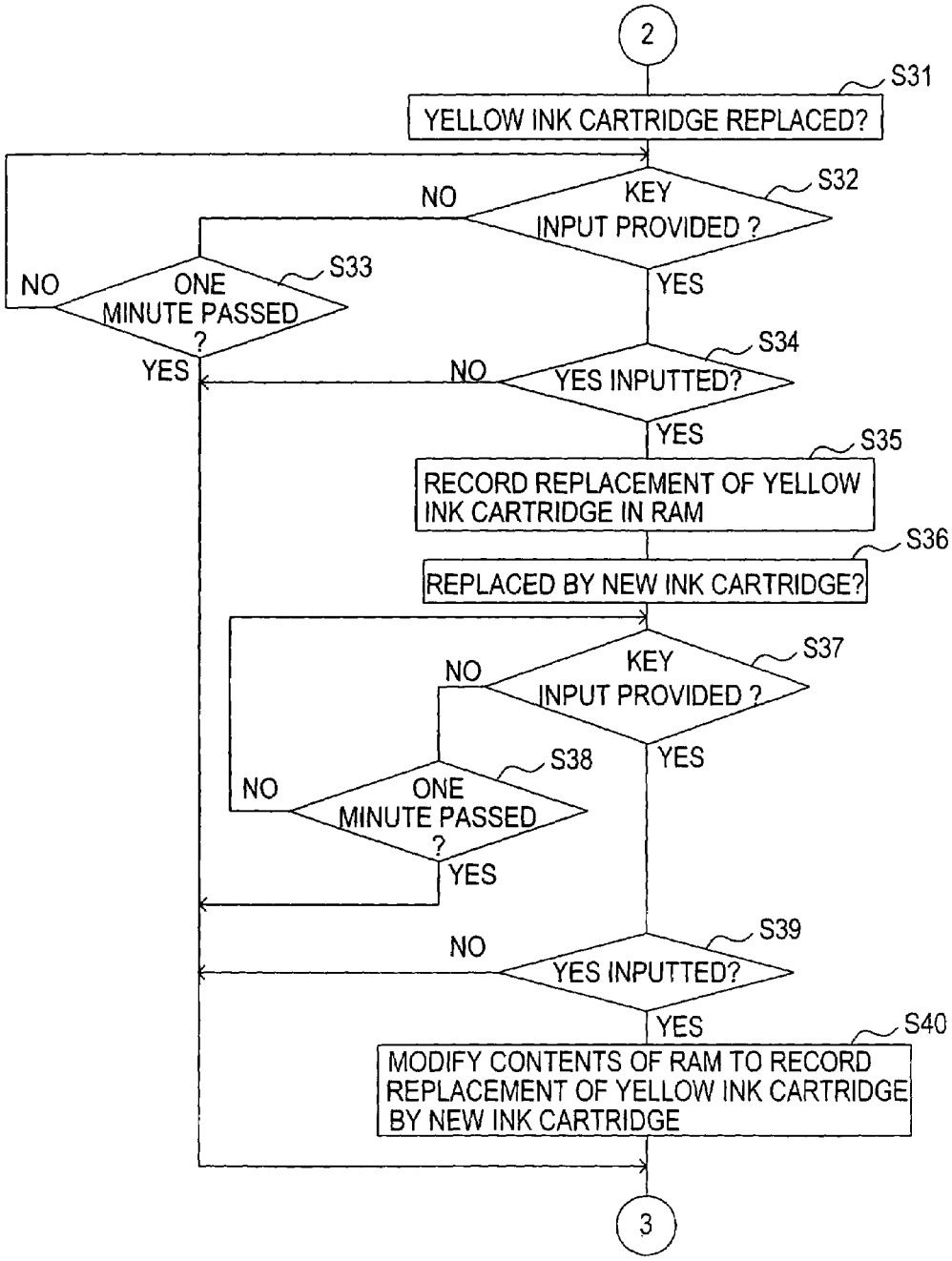
FIG. 9 is a flowchart of a further continuation of the replacement state query process.
Figure 10:
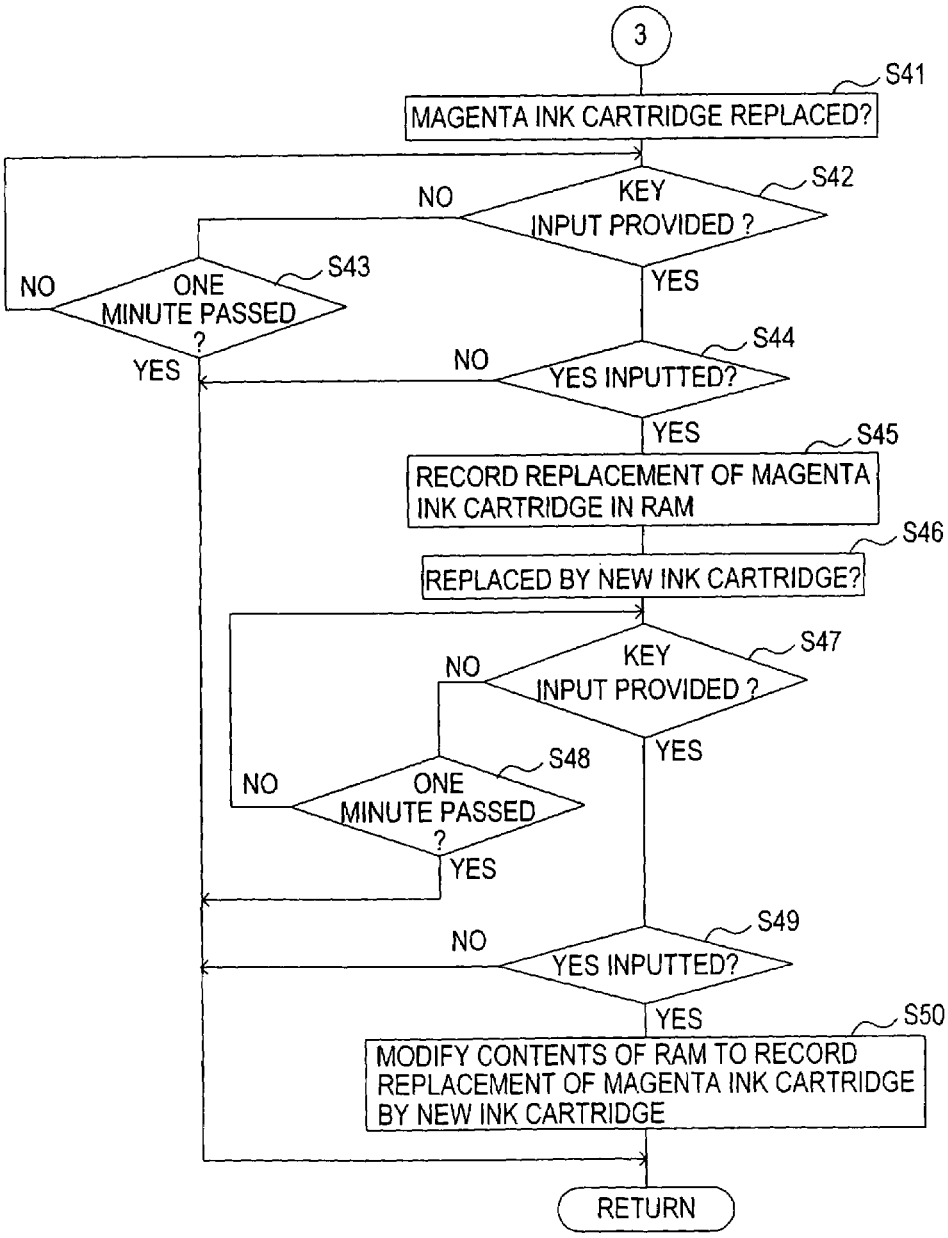
FIG. 10 is a flowchart of a further continuation of the replacement state query process.

From S21 to S30 illustrated in FIG. 8, the same process as described in S11 to S20 is performed with respect to whether or not the cyan ink cartridge 11*c* has been replaced (S21 to S25), and whether or not the cyan ink cartridge 11*c* has been replaced by a new ink cartridge (S26 to S30). Subsequently from S31 to S35 illustrated in FIG. 9, the same process as described in S11 to S20 is performed with respect to whether or not the yellow ink cartridge 11*y* has been replaced (S31 to S35), and whether or not the yellow ink cartridge 11*y* has been replaced by a new ink cartridge (S36 to S40). Further subsequently, from S41 to S50 illustrated in FIG. 10, the same process as described in S11 to S20 is performed with respect to whether or not the magenta ink cartridge 11*m* has been replaced (S41 to S45), and whether or not the magenta ink cartridge 11*m* has been replaced by a new ink cartridge (S46 to S50). The procedure moves to S60 in FIG. 6.

In S60, it is determined whether or not the ink cartridge 11 has been replaced based upon the results of the replacement state query process (from S11 to S50). When it is determined that no ink cartridge 11 has been replaced at all (S60: NO), the carriage 15 is moved to the flushing area. The actuators 13*b*, 13*c*, 13*y*, and 13*m* of the recording heads 10 corresponding to the ink cartridges 11*b*, 11*c*, 11*y*, and 11*m* are driven; flushing is performed to all of the recording heads 10; and the procedure moves to S1.

On the other hand, when it is determined that at least one ink cartridge 11 has been replaced (S60: YES), the procedure moves to S62. In S62, it is determined whether or not the ink cartridge 11 has been replaced by a new ink cartridge. If it is determined that no ink cartridge 11 has been replaced by a new ink cartridge (S62: NO), a pair of nozzle arrays (the nozzle array of the recording head corresponding to the replaced ink cartridge, and the nozzle array for the color which is the counterpart thereof) are moved to the front of the suction cap 16 for a single purge. Then, the procedure moves to S1 (S63). The width of the suction cap 16 is designed so as to cover the nozzle arrays of the two recording heads 10 as illustrated in FIG. 2B. The purging operation is performed to magenta and yellow, simultaneously. Likewise, the purging operation is performed to cyan and black, simultaneously. In S63, for example, when it is determined that the cyan ink cartridge 11*c* has been replaced by a previously used ink cartridge, a single purge (a single purging operation) is performed with respect to the nozzle arrays of cyan and black.

Back in FIG. 6, if it is determined that the ink cartridge 11 has been replaced by a new ink cartridge (S62: YES), the procedure moves to S64. In S64, the dot count is cleared for the replaced ink cartridge 11. The dot count is increased every time a single dot is ejected. The dot count is used for various processes; such as an ink level display, which will be described hereinafter, and a warning of ink shortage. However, the dot count is not cleared for the ink cartridge 11 which has been replaced by a previously used ink cartridge (see S62 and S63).

In S65, the replacement purge is performed to the nozzle array corresponding to the new ink cartridge 11. The replacement purge refers to an operation in which the purge is repeated as many times as necessary until ink in the new ink cartridge 11 reaches the corresponding nozzle array of the recording head. As described above, the replacement purge is also simultaneously performed to the nozzle array for the color which is the counterpart of the new ink cartridge color. In S66, as in S61, flushing is performed to the recording head 10 by actuating the actuator 13 of the recording head 10 corresponding to the ink cartridge 11 for the color which has not been replaced by a new ink cartridge, and the procedure moves to S1.

Figure 11:
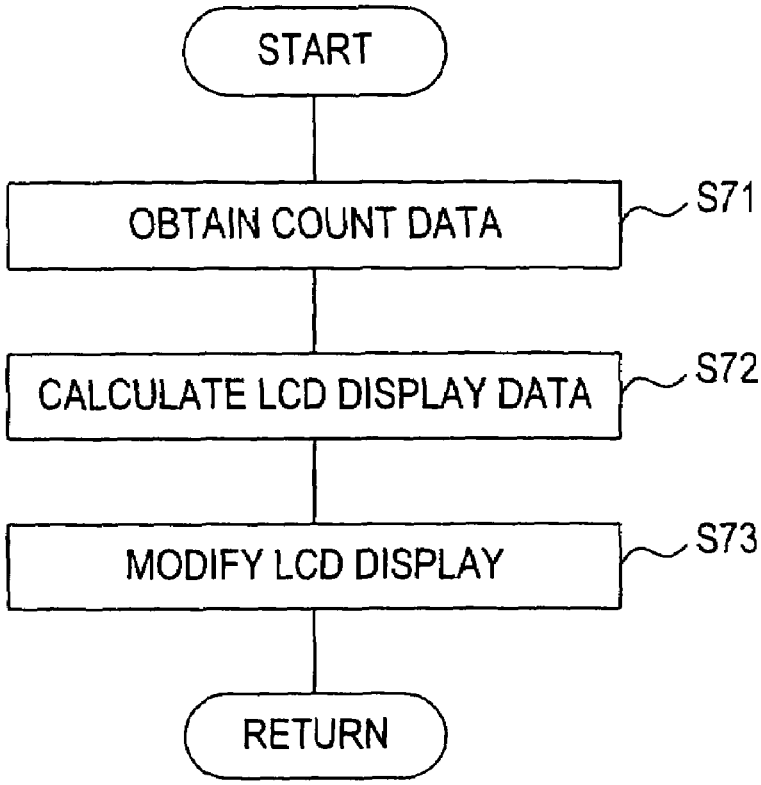
FIG. 11 is a flowchart of an ink level display process that the control system executes.

The process of an ink level display will now be described as an example of the process using the aforementioned dot count. FIG. 11 is a flowchart of an ink level display process. The CPU 51 repeatedly performs the process for every predetermined time period. As illustrated in FIG. 11, once the process gets started, the dot count data is obtained in S71. In S72, the data (the counting value of the ejected dots) is checked against a predetermined table and the display data for displaying the ink level on the LCD 5*a* is calculated. In case that the ink cartridges 11 of various sizes are attachable to the recording head 10, various kinds of the tables may be prepared according to the sizes thereof.

Figure 12:
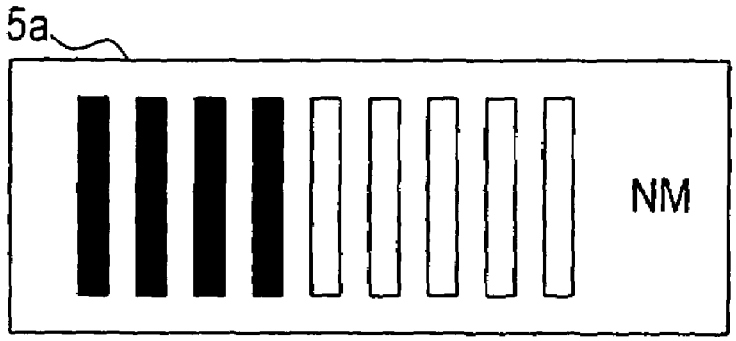
FIG. 12 is an explanatory view of a LCD display in the ink level display process.

In S73, the display of the LCD 5*a* is altered based upon the calculated display data, and one cycle of the process is completed. By this process, a display, in which squares are filled according to the remaining amount of ink, is shown on the LCD 5*a* as illustrated in FIG. 12. Because the dot count for the new ink cartridge 11 is cleared in the aforementioned process, the display on the LCD 5*a* preferably corresponds to the actual remaining amount of ink.

Thus, in the multifunction device 1 of the present embodiment, the user is asked in the replacement state query process which ink cartridge 11 has been replaced and which ink cartridge 11 thereof has been replaced by a new ink cartridge (e.g. which replaced ink cartridge is new). Thereafter, the maintenance is performed according to each of the replacement states. In short, flushing is performed to un replaced ink cartridges 11, a single purge is performed to the ink cartridges 11 which have been replaced by ink cartridges previously used, and a replacement purge is performed to the ink cartridges 11 which have been replaced by new ink cartridges.

Therefore, it is possible to maintain the ejection performance of the recording head 10 corresponding to the ink cartridges 11 not replaced by new ink cartridges. Furthermore, it is possible to maintain a state in which images are ready to be formed any time by the replacement purge to the nozzle array of the recording head 10 corresponding to the ink cartridge 11 which has been replaced by the new one.

In the replacement state query process (S10) and the subsequent maintenance process (S60 to S66), the closing of the upper body 2*b* is identified as a trigger for purging operation. Consequently, even if the user takes some time for replacement of ink, an error, e.g. a time-out, does not occur. Furthermore, maintenance is not performed with the upper body 2*b* open.

In the multifunction device 1, regardless of the relatively rough positional relationship between the protruding portion 20 and the penetrating hole 5*c*, the tactile-response engagement can be desirably achieved. Consequently, the closing of the upper body 2*b* can be preferably detected. Additionally, even if the protruding portion 20 and the penetrating hole 5 are provided at only one place, the upper body 2*b* can be reliably retained in a closed position. As a result, in the multifunction device 1, the manufacturing cost is reduced and the reliability of the opening and closing detection of the upper body 2*b* is improved, whereby the reliability of the control is enhanced as well. Also, the protruding portion 20 is easily constricted in the longitudinal direction due to the crushing of the hexagon shaped member, which also inhibits excessive force from being applied to the transfer member 26. Therefore, the positional relationship may be made rougher, so that the manufacturing cost can be further reduced.

The present embodiment is not to be limited to the forms of the embodiment described above, and modifications and substitutions by one of ordinary skill in the art are considered to be within the scope of the present invention. For example, the ink cartridge may be the one to be replaced by the opening and closing of a different cover than the body cover provided on the side or the back of the apparatus. In this case, the same control as described above may be performed by detecting the opening and closing of the different cover.

The ink cartridge is not necessarily divided into the colors of magenta, yellow, cyan, and black. The ink cartridge may be divided into two colors of black and color, or may be the same color with different shades. Furthermore, in spite whether or not the ink cartridge 11 has been replaced by a new ink cartridge, the replacement purge may be performed to the nozzle array of the recording head corresponding to the replaced ink cartridge.

However, the query of whether or not the ink cartridge 11 has been replaced by a new ink cartridge, allows the maintenance to be performed more appropriately as above. Furthermore, ink consumption used by maintenance can be reduced, and the image forming is preferably performed. Also, in the mode of the present embodiment, the purge is performed to the nozzle arrays of two colors. However, if the purge can be performed for each color, the purge is to be performed only to the nozzle array of the recording head corresponding to the replaced color ink cartridge. Consequently, the purge is reliably inhibited for any nozzle arrays of the recording heads corresponding to the un-replaced color ink cartridges, and the waste of ink is preferably avoided. In S66, the single purge may be performed to the ink cartridges 11 which have not been replaced by new ink cartridges.

Figure 13:
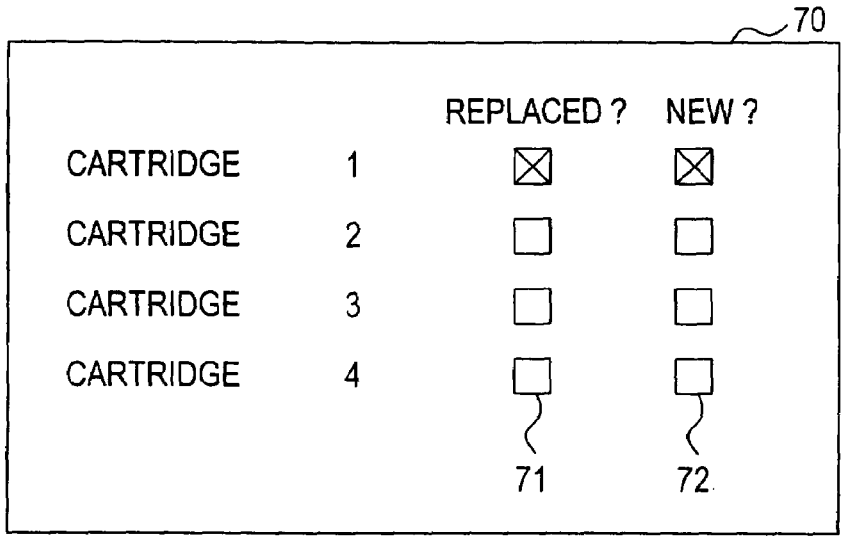
FIG. 13 is an explanatory view of a computer screen in the ink level display process.

In the mode of the present embodiment, the multifunction device 1 is configured to be used as a stand-alone device. The replacement state query process is performed via the LCD 5*a* of the operation panel 5. However, if the process is performed through a connection with a personal computer (hereinafter referred to as a PC) via parallel cable, etc., the replacement state query process is performed using the computer screen shown in FIG. 13. In this case, the query messages about the replacement of colors (see S11, S16, S21, S26, S31, S36, S41, and S46) can be displayed on one screen 70 along with check boxes 71 and 72. The message can be remotely operated via the PC.

What is claimed is:

1. An image forming apparatus comprising:

a plurality of ink cartridges each containing ink;

a plurality of ink recording heads each ejecting ink contained in a respective one of the plurality of ink cartridges through a nozzle array so as to form an image on a recording medium;

a cover which is configured to open and close so as to allow replacement of the plurality of ink cartridges;

an input device which provides a user interface;

a cover closing detection device which detects at least the closing of the cover from an unclosed state;

a query device which displays a request for input regarding actual replacement of one of the plurality of ink cartridges, and functions after a replacing ink cartridge input is received from the input device and after the cover closing detection device detects the closing of the cover; and a maintenance device which performs maintenance of the plurality of recording heads according to input from the input device after the functioning of the query device.

2. The image forming apparatus as set forth in claim 1, further comprising:

a first timer used to measure a first predetermined time between the functioning of the query device and the receiving of input by the input device, wherein the maintenance performed by the maintenance device on all of the plurality of recording heads after the first timer measures the first predetermined time period and after no input from the input device, is flushing.

3. The image forming apparatus as set forth in claim 2, wherein the query device comprises:

a first query device which displays the request for input regarding actual replacement of the plurality of ink cartridges;

a second query device which displays a request for input regarding a status of a replaced ink cartridge and functions for replaced ink cartridges where the input from the input device is that the ink cartridge was actually replaced;

a second timer to measure a second predetermined time between the functioning of the second query device and the receiving of input by the input device;

a query status determination unit which determines whether a second query status of the replaced ink cartridge is a new ink cartridge, a used ink cartridge, or no input received by the input device after the second timer measures the second predetermined time period, and wherein the maintenance device performs a different level of maintenance on the nozzle array of the recording head corresponding to the replaced ink cartridge where the second query status determined by the query status determination unit is the new ink cartridge than the level of maintenance performed on the nozzle array of the recording head corresponding to the replaced ink cartridge wherein the second query status is one of, the used ink cartridge, and the no input received by the input device.

4. The image forming apparatus as set forth in claim 3, wherein the maintenance is purging for the nozzle array of the recording head corresponding to the replaced ink cartridge where the second query status determined by the query status determination unit is the new ink cartridge, and wherein the maintenance is repeated until the ink in the replaced ink cartridge reaches the nozzle array.

5. The image forming apparatus as set forth in claim 4, wherein the maintenance is purging for the nozzle array of the recording head corresponding to the replaced ink cartridge where the second query status determined by the query status determination unit is one of the used ink cartridge and the no input received by the input device, and wherein the maintenance is only performed once in response to the functioning of the second query for the replaced ink cartridge.

6. The image forming apparatus as set forth in claim 5, wherein the recording head comprises a nozzle array corresponding to one of different color ink cartridges, and wherein the query device functions sequentially for the each color.

7. The image forming apparatus as set forth in claim 6, wherein the maintenance device is configured to be able to perform a purging operation at least to the nozzle array of the recording head corresponding to the replaced color ink cartridge, and repeats the purging operation a plurality of times to the nozzle array of the recording head corresponding to the replaced color ink cartridge, or to a pair of nozzle arrays including that nozzle array, and performs the purging operation fewer times to the other nozzle arrays.

8. The image forming apparatus as set forth in claim 6, wherein the query device displays the requests on a display portion of the image forming apparatus.

9. The image forming apparatus as set forth in claim 8, wherein the input device is configured as an operation panel of the image forming apparatus.

10. The image forming apparatus as set forth in claim 8, wherein the input device is configured as an information processing device which is connected to the image forming apparatus.

11. The image forming apparatus as set forth in claim 10, wherein the ink cartridge is mounted on a carriage along with the recording head, and wherein the cover is a body cover of the image forming apparatus.

12. The image forming apparatus as set forth in claim 5, wherein the recording head comprises a nozzle array corresponding to one of different color ink cartridges, wherein each ink cartridge contains at least one color of the ink, and wherein the query device functions sequentially for the each ink cartridge.

13. The image forming apparatus as set forth in claim 1, wherein the request for input regarding actual replacement of one of the plurality of ink cartridges includes an inquiry whether or not one of the plurality of ink cartridges has been replaced.

14. The image forming apparatus as set forth in claim 1, wherein the input device is configured to receive the replacing ink cartridge input in response to the request displayed on the query device, and the replacing ink cartridge input indicates whether or not one of the plurality of ink cartridges has been replaced.

15. An image forming apparatus comprising:

a plurality of ink cartridges each containing one color of ink;

a plurality of recording heads each ejecting ink contained in a respective one of the ink cartridges through a nozzle array so as to form an image on a recording medium;

a cover which is configured to open and close so as to allow replacement of the plurality of ink cartridges;

an input device which provides a user interface;

a cover closing detection device which detects at least the closing of the cover from an unclosed state;

a first query device which displays a request for input regarding actual replacement of the plurality of ink cartridges;

a second query device which displays a request for input regarding a status of a replaced ink cartridge and functions for replaced ink cartridges where the input from the input device received after the first query is that the ink cartridge was actually replaced, the first and second query devices functioning after the cover closing detection device detects the closing of the cover, and functioning sequentially for the ink cartridges that are included in the image forming apparatus;

a first timer to measure a first predetermined time between the functioning of the first query and the receiving of input by the input device;

a second timer to measure a second predetermined time between the function of the second query and the receiving of input by the input device;

a query status determination unit which determines whether a second query status of the replaced ink cartridge is a new ink cartridge, a used ink cartridge, or no input received by the input device after the second timer measures the second predetermined time period; and a maintenance device which performs maintenance to at least one nozzle array corresponding to at least one of the recording heads corresponding to input from the input device after the functioning of the first and second query devices.

16. The image forming apparatus set forth in claim 15, wherein the maintenance device performs (a) a flushing of all of the recording heads when the query status determination unit determines that the first timer has measured a first predetermined time period after the closing of the cover, (b) a purging of the nozzle array of the recording head corresponding to the replaced ink cartridge when the query status determination unit determines that the second query status is new ink cartridge, and repeats the purging until ink reaches the nozzle array, and (c) single purging of the nozzle array of the recording head corresponding to the replaced ink cartridge when the query status determination unit determines that the second query status is one of used ink cartridge and no input received by the input device.

17. An image forming apparatus comprising:

a plurality of ink cartridges each containing one color of ink;

a plurality of recording heads each ejecting ink contained in a respective one of the plurality of ink cartridges through at least one nozzle array so as to form an image on a recording medium;

a cover which is configured to open and close so as to allow replacement of the plurality of ink cartridges;

an input device which provides a user interface;

a cover closing detection device which detects at least the closing of the cover from an unclosed state;

a query device, which includes a display, functions to display a request for input regarding actual replacement of all or at least one of the ink cartridges along with a request for input regarding a status of each replaced ink cartridge, includes a timer to measure time between the functioning of the query device display requesting the input and receiving the input by the input device, and functions after the cover closing detection device detects the closing of the cover;

a query status determination unit which determines whether a status of the replaced ink cartridge is a new ink cartridge or a used ink cartridge; and a maintenance device which performs maintenance to at least one of the nozzle array of a corresponding one of the plurality of recording heads corresponding to input from the input device after the functioning of the query device, and performs (a) a flushing of all of the recording heads after the timer measures a predetermined time period and after the closing of the cover, (b) a purging of the nozzle array of the recording head corresponding to the replaced ink cartridge when the query status determination unit determines that the status is new ink cartridge, and repeats the purging until ink reaches the nozzle array, and (c) single purging of the nozzle array of the recording head corresponding to the replaced ink cartridge when the query status determination unit determines that the status is used ink cartridge.

18. The image forming apparatus set forth in claim 17, wherein the selection of the status for the ink cartridge satisfies the request for input regarding the actual replacement and the request for input regarding the status of the replacement cartridge.

* * * * *